US006935202B2

(12) United States Patent
Siems et al.

(10) Patent No.: US 6,935,202 B2
(45) Date of Patent: Aug. 30, 2005

(54) STARTER

(75) Inventors: Hans-Dieter Siems, Eberdingen (DE); Ingo Richter, Markgroeningen (DE); Sven Hartmann, Stuttgart (DE); Hans Braun, Stuttgart (DE); Juergen Kugler, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 4 days.

(21) Appl. No.: 10/380,595

(22) PCT Filed: Jul. 11, 2002

(86) PCT No.: PCT/DE02/02533

§ 371 (c)(1),
(2), (4) Date: Aug. 1, 2003

(87) PCT Pub. No.: WO03/008798

PCT Pub. Date: Jan. 30, 2003

(65) Prior Publication Data

US 2004/0011151 A1 Jan. 22, 2004

(30) Foreign Application Priority Data

Jul. 19, 2001 (DE) ..... 101 35 141

(51) Int. Cl.[7] ..... F02N 1/00

(52) U.S. Cl. ..... 74/9; 74/7 R; 123/179.28; 180/165

(58) Field of Search ..... 74/6, 7 R, 7 E, 74/9; 123/179.28; 180/165

(56) References Cited

U.S. PATENT DOCUMENTS

| | | | | |
|---|---|---|---|---|
| 1,753,584 A | | 4/1930 | Teeter | |
| 5,255,644 A | * | 10/1993 | Mills et al. | 123/179.31 |
| 5,291,861 A | * | 3/1994 | Bartlett | 123/179.31 |
| 5,596,902 A | * | 1/1997 | McMillen | 74/7 C |
| 6,561,336 B1 | * | 5/2003 | Huart et al. | 192/70.25 |

FOREIGN PATENT DOCUMENTS

| | | |
|---|---|---|
| DE | 196 25 057 C1 | 7/1997 |
| DE | 100 16 706 A | 10/2001 |

OTHER PUBLICATIONS

Patent Abstracts of Japan vol. 007, No. 009 (M–185), Jan. 14, 1983 & JP 57 168057 A, Oct. 16, 1982.

* cited by examiner

*Primary Examiner*—David M. Fenstermacher
(74) *Attorney, Agent, or Firm*—Michael J. Striker

(57) ABSTRACT

An inertia-drive starter is proposed, in the case of which a relay is not required to engage the pinion in the flywheel ring gear (47) of an internal combustion engine. With this starter, a pushing-forward of the driven shaft (33) to engage a pinion (45) in the flywheel ring gear (47) is brought about by means of a pole tube (9) located on the stator (5) of the starter motor (5, 7), which said pole tube executes a turning motion around the motor axis when the starter motor (5, 7) is energized. Means (55, 63, 77, 79) are provided that convert the turning motion of the pole tube (9) directly into an axial motion acting on the driven shaft (33).

8 Claims, 3 Drawing Sheets

STARTER

BACKGROUND OF THE INVENTION

The present invention concerns a starter for an internal combustion engine that comprises a starter motor, a drive shaft capable of being driven by the starter motor, and a driven shaft that is mechanically linked with the drive shaft and is displaceable in the direction of its longitudinal axis, which said driven shaft is equipped with a pinion capable of being pushed into mesh with a flywheel ring gear of the internal combustion engine, whereby a pushing-forward of the driven shaft to engage the pinion in the flywheel ring gear takes place by means of an element located on the stator of the starter motor that executes a turning motion around the motor axis when the starter motor is energized.

"Inertia-drive" starters are widespread as starters for internal combustion engines. These inertia-drive starters have an electrical starter motor, the drive shaft of which is mechanically linked with a driven shaft that is displaceable in the direction of its longitudinal axis. On the end furthest from the starter motor, the drive shaft is equipped with a helical spline, on which a driving element of the driven shaft is turnably and displaceably located. This driving element of the driven shaft is interconnected via a roller-type overrunning clutch with a shaft comprising the pinion. When the starter motor is switched on, the driven shaft—with the driving element, the roller-type overrunning clutch, and the pinion shaft—are pushed forward in such a fashion that the pinion meshes with a flywheel ring gear of the internal combustion engine. The mechanical meshing function usually takes place by means of a mechanical relay that usually performs the switching function for the starter motor as well. This combination of pinion-engaging and switching function requires that a starter relay be attached to the starter. Since the starter is located in the crumple zone of a vehicle, there is a danger that, if an accident occurs, parts of the starter relay supplied with battery voltage can come into contact with the grounded vehicle body, which would cause a short circuit. A previously-disclosed starter is made known in DE 196 25 057 C1, for example.

A starter that functions without an attached starter relay that carries out the pinion-engaging function of the starter is based on the older German application 100 16 706.3. This starter functions according to the "braking-inertia drive" principle. The starter motor comprises a pole tube that executes a turning motion around the motor axis when the motor is energized. This turning motion of the pole tube starts a braking mechanism that exerts braking torque on the driving element of the driven shaft. This braking torque causes the driving element to be advanced by the helical spline on the drive shaft of the motor, so that the pinion of the starter engages in the flywheel ring gear of the internal combustion engine. According to the exemplary embodiments of the older German application, the braking device comprises either a brake drum interconnected with the driving element, against which said brake drum a stop block is pressed, or it comprises a pawl that is capable of being moved against a disk interconnected with the driving element with frictional engagement, whereby braking torque is exerted on the driving element by means of the positive connection between the pawl and the disk. For the stop block or the pawl to change position, a force must be exerted in the radial direction relative to the driving element, which said force is derived from the turning motion of the pole tube by means of a mechanism.

ADVANTAGES OF THE INVENTION

According to the features of claim 1, means are provided that convert the turning motion of a stator element around the motor axis—which said turning motion is produced when the starter motor is energized—directly into an axial motion acting on the driven shaft. With this invention, a starter relay can be eliminated that initiates a pushing-forward of the driven shaft for the pinion-engaging procedure. Additionally, the conversion of the turning motion of the starter element into an axial motion acting on the driven shaft can be carried out with very simple technical means.

Advantageous exemplary embodiments and further developments of the invention are based on the dependent claims.

An advantageous exemplary embodiment for converting the turning motion of the stator element into an axial motion of the driven shaft can comprise the following: a guide track and a guide device capable of gliding along said guide track are provided, whereby the guide track or the guide device are mechanically linked with the axially displaceable driven shaft, and the guide device or the guide track is located on a part of the starter that does not move axially with the driven shaft. The stator element is mechanically linked with the guide track or the guide device in such a fashion that the guide device glides along the guide track when the stator element executes a turning motion. The guide track and the guide device have shapes that allow the driven shaft to execute an axial motion when the guide device glides along the guide track. Balls or rolling elements, for example, can be inserted to reduce friction between the guide track and the guide device.

A substantially radially projecting disk is supported, in advantageous fashion, on the driven shaft in such a fashion that it is turnable around the axis of the driven shaft and bears axially against a spring force in the advancing direction. This spring force supports the engagement of the starter pinion in the flywheel ring gear of the internal combustion engine.

The starter element can be interconnected with the disk with positive and/or non-positive engagement in such a fashion that, when the stator element executes a turning motion, a guide device located on the disk glides along a guide track rising in the advancing direction of the driven shaft, which causes the disk to execute an axial motion with the drive shaft.

The guide track or the guide device can be located on the stator element, for example.

Advantageously, the stator element comprises a pole tube belonging to the stator, which said pole tube is supported in a fashion that allows it to turn around the motor axis, whereby a spring element can be present that counteracts the torque produced when the motor is energized and acts on the pole tube.

It is advantageous for a spring element to be inserted between the disk and the housing of the starter, which said spring element exerts a spring force opposed to the advancing direction on the disk and, therefore, the driven shaft. This spring element supports the pinion-disengaging procedure of the starter.

As with a conventional inertia-drive starter, the driven shaft of the starter according to the invention is also driven in advantageous fashion via a helical spline on the drive shaft.

SUMMARY OF THE DRAWINGS

The invention will be explained in greater detail hereinbelow with reference to exemplary embodiments presented in the drawings.

DESCRIPTION OF THE PREFERRED EMBODIMENTS

Figure 1:
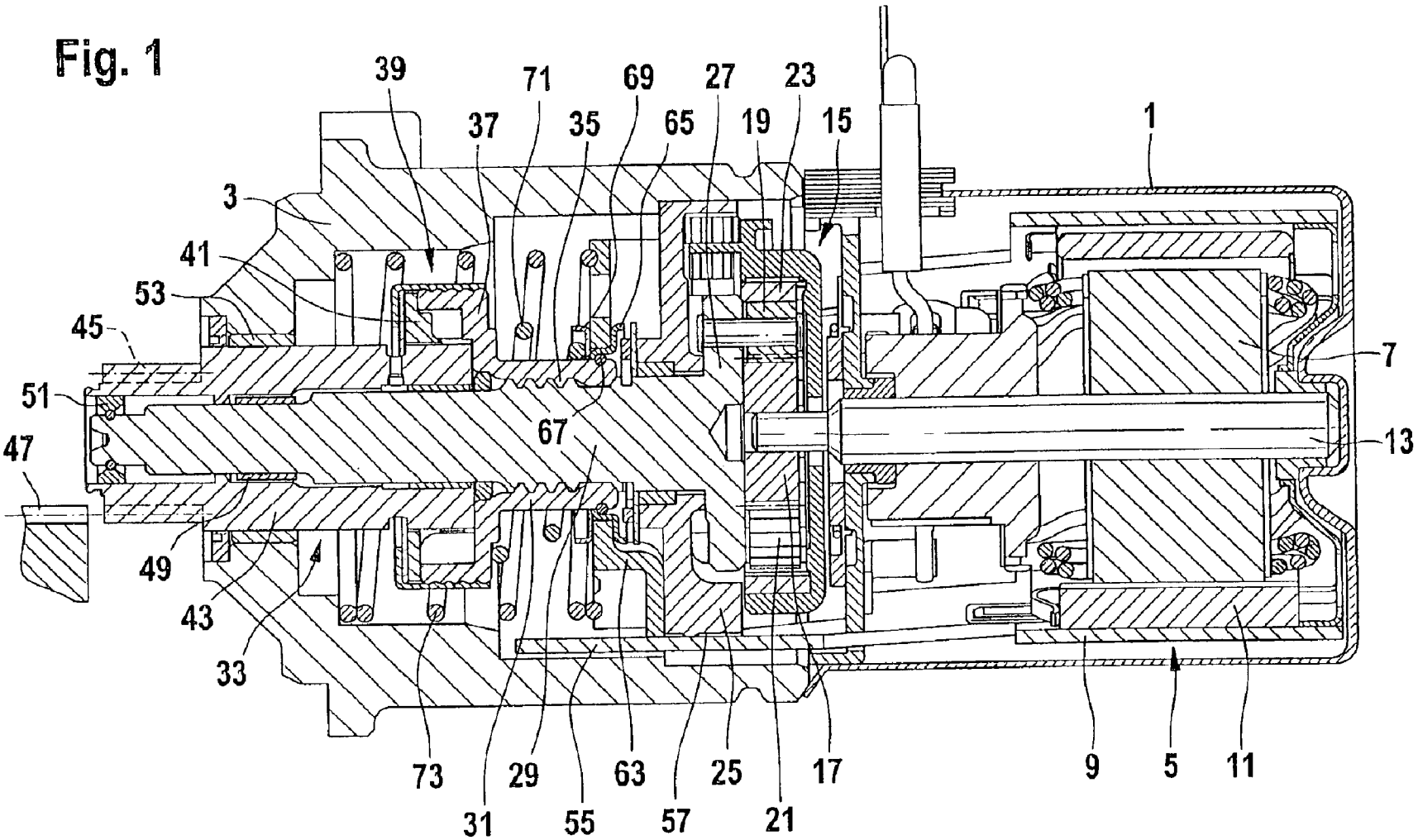
FIG. 1 is a longitudinal sectional drawing through a starter.

The starter shown as a longitudinal sectional drawing in the figure comprises a double-component housing, whereby a housing part 1 encloses a starter motor, and a second housing part 3 accommodates the drive end bearing of the starter. The starter motor comprises, in known fashion, a stator 5 and a rotor 7 turnably supported therein. The stator 5 comprises a pole tube 9 and stator poles 11 designed as permanent magnets located therein. The pole tube 9 forms the magnetic yoke for the stator poles 11 that are located concentrically around the rotor 7. The rotor 7 comprises a motor shaft 13 that is interconnected in torsion-resistant fashion with a laminated stack. One or more rotor windings are inserted in not-shown grooves of the laminated stack.

The motor shaft 13 projecting out of the starter motor is coupled with a gearset, preferably a planetary gearset 15. The motor shaft 13 drives a sun gear 17, and the sun gear 17 meshes with planet gears 19 and 21 that walk around inside a ring gear 23. The ring gear 23 is interconnected with an intermediate bearing 25. The planet gears 19 and 21 are held by a planetary-gear carrier 27. The intermediate bearing 25 is situated in the housing 3 of the starter in a stationary, torsion-resistant fashion. The planetary-gear carrier 27 is interconnected with a drive shaft 29 in torsion-resistant fashion, e.g., it is integral therewith.

A driving element 31 of a driven shaft 33 is mounted on the drive shaft 29. The drive shaft 29 and the driving element 31 are coupled with each other via a helical spline 35. This helical spline that joins the drive shaft 29 and the driving element 31 is a "pinion-engaging drive". The driving element 31 transitions into an outer ring 37 of a roller-type overrunning clutch 39. The outer ring 37 of the roller-type overrunning clutch 39 drives—via not-shown sprags—an inner ring 41 that is interconnected with a pinion shaft 43 of the driven shaft 33. The pinion shaft 43 is equipped with a pinion 45 on its end projecting out of the housing 3 of the starter. When the motor shaft 13 turns, the pinion-engaging gear developed as helical spline 35 between the drive shaft 29 and the driven shaft 33 pushes the pinion shaft 43 forward, so that the pinion 45 meshes with a flywheel ring gear 47 of a not-shown internal combustion engine. The engaging procedure and the disengaging procedure are described in greater detail hereinbelow.

In the case of the exemplary embodiment shown in FIG. 1, the drive shaft 29 is turnably supported inside the driven shaft 33 by means of two bearings 49 and 51 arranged axially in tandem. Moreover, the driven shaft 33 is supported in the housing part 3 via a bearing 53 in a fashion that allows it to rotate around its longitudinal axis.

Figure 2:
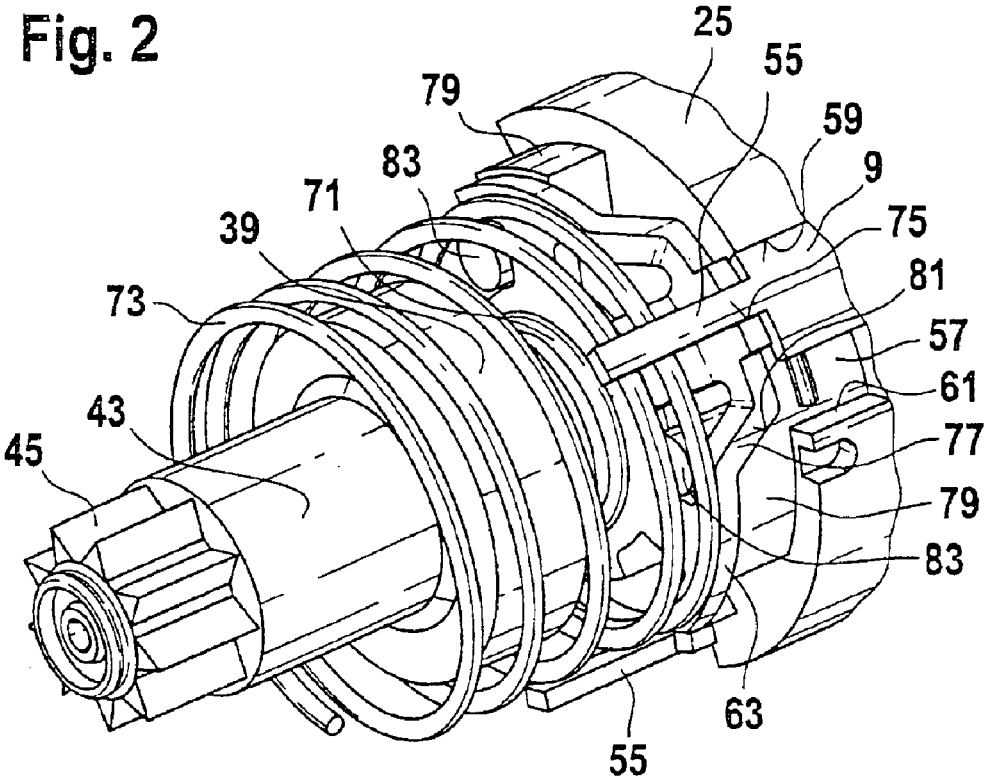
FIGS. 2 through 4 are three-dimensional representations of a section of a starter with the pole tube and the driven shaft in various positions.
Figure 3:
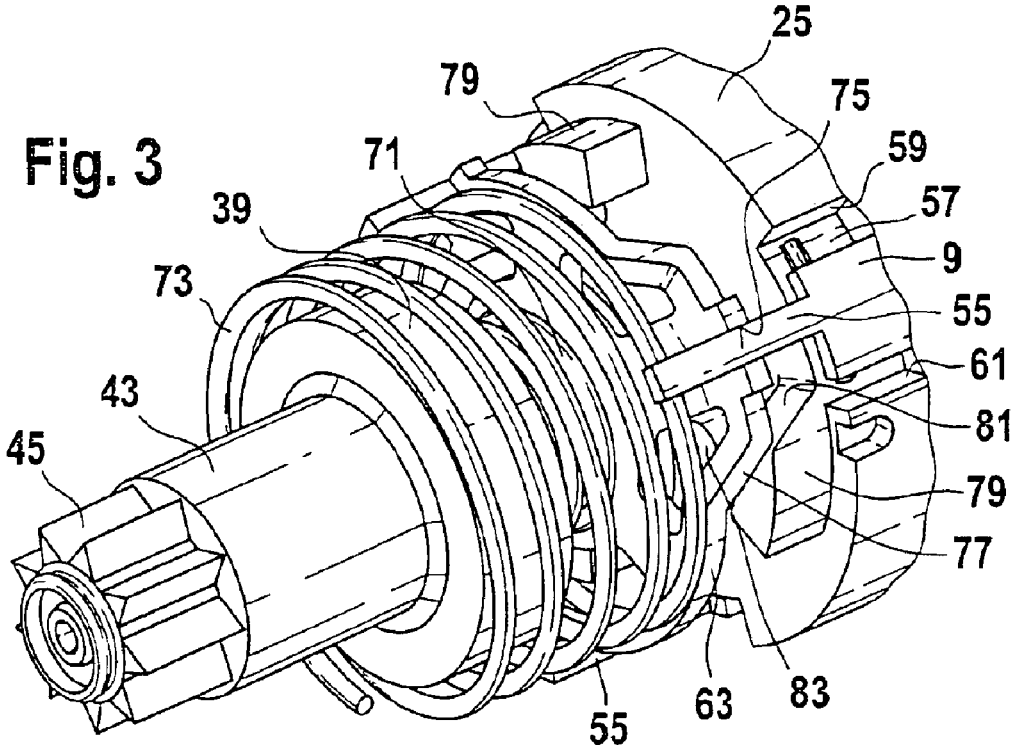
Figure 4:
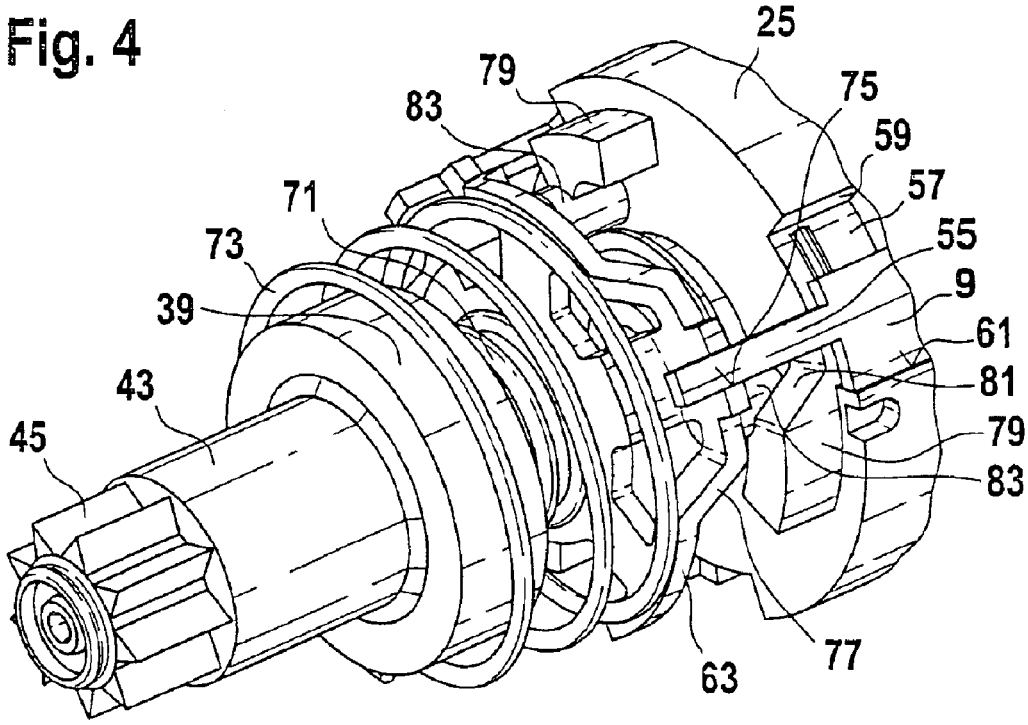

The pole tube 9 of the starter motor is supported in a fashion that allows it to turn around the motor axis (motor shaft 13) at a certain angle (approx. 10° to 30°). One or more—preferably three—arms 55 are located on the pole tube 9 that extend into the housing part 3 in which the gearset for driving the driven shaft 33 is located. Each arm 55 of the pole tube 9 is guided through an opening 57 in the outer circumference of the intermediate bearing 55 located in the housing part 3 in torsion-resistant fashion. Each opening 57 in the intermediate bearing 25 has two stops 59 and 61 that limit the turning motion of the pole tube 9 around the motor axis. The perspective representations of a section of the starter shown in FIGS. 2 through 4 shows an opening 57 in the intermediate bearing 25 with its two stops 59 and 61 and an arm 55 of the pole tube 9 guided therein.

As soon as the starter motor is energized, torque acts on the pole tube 9—due to electromagnetic forces acting between rotor and stator—by way of which the pole tube 9 is turned around the motor axis in a certain direction, e.g., in the clockwise direction. A spring element—not shown in the drawing—is provided that counteracts this torque of the pole tube 9. The spring element can be installed on the intermediate bearing 25, for example. The level of torque acting on the pole tube 9 depends on the strength of the current flowing through the rotor windings.

A substantially radially projecting disk 63 is supported on the driving element 31 of the driven shaft 33 in such a fashion that it can be turned around the axis of the driving element 31 of the driven shaft 33. The disk 63 is secured against axial displacement in the direction opposite to the advancing direction of the driven shaft 33. This is ensured by means of the holding ring 65 mounted on the driving element 31, against which said holding ring the disk 63 bears. The holding ring 65 is secured against axial displacement in the direction opposite to the advancing direction of the driven shaft 33 by means of a retainer 67. On the side of the disk 63 facing the roller-type overrunning clutch 39, a support ring 69 is mounted on the driving element 31, which said support ring is pressed against the disk 63 by a spring 71 bearing against the outer ring 37 of the roller-type overrunning clutch 39. Due to the function it performs when the pinion 45 engages in the flywheel ring gear 47, this spring shall be referred to as "pinion-engaging spring" 71 hereinbelow. A further spring 73 is inserted between the disk 63 and the housing part 3, which said spring—like the pinion-engaging spring 71—exerts pressure on the disk 63 and, therefore, on the driven shaft 33 in a direction opposite to the advancing direction of the driven shaft 33. This second spring 73 shall be referred to hereinbelow as the pinion-disengaging spring, because it helps to disengage the pinion 45 from the flywheel ring gear 47. The engaging and disengaging forces mentioned hereinabove can also be applied by other spring elements that are located in places in the starter other than those shown in the figures. For example, the pinion-disengaging spring 73 could also be inserted between the pinion shaft 43 of the axially displaceable driven shaft 33 and the pinion-side end of the axially immobilized drive shaft 29.

The pinion-engaging procedure will now be described with reference to FIGS. 2 through 4, which represent various stages of the pinion-engaging procedure.

On its outer edge, the disk 63 comprises one opening 75 for each arm 55 of the pole tube 9 that is sized so that the respective arm 55 of the pole tube 9 has no clearance in the radial direction, but within which the arm 55 is capable of being displaced in the axial direction. This makes it possible for the disk 63 to turn when the pole tube 9 executes a turning motion on the driving element 31, but the disk 63 can be displaced in the axial direction relative to the pole tube 9. The disk 63 comprises at least one axial bulge 77 oriented toward the pole tube 9. An axial projection 79 facing the disk 63 is located on the stationary intermediate bearing 25 in the region of each bulge 77 of the disk 63. The projection 79 is equipped with a guide track 81, along which the bulge 77 of the disk 63 can glide, whereby the bulge 77 and the guide track 81 comprise a shape that allows the disk 63 to be pushed forward when its bulge 67 glides along the guide track 81.

FIG. 2 shows the starter in its neutral position when the starter motor is not energized. No torque is acting on the pole tube 9, and said pole tube bears against the left stop 59 of the opening 57 in the intermediate bearing 25. In this neutral position, the driven shaft 33 with the disk 63 located on it is pushed so far back in the direction toward the starter motor that the bulge on the disk 63 bears against the intermediate bearing 25. If the starter motor is now energized, torque is applied to the pole tube 9 in the clockwise direction as viewed from the pinion-end of the starter in the exemplary embodiment shown in FIGS. 2 through 4. As the motor current increases, the pole tube 9, with its arms 55, turns in the direction toward the second stop 61 of the opening 57 in the intermediate bearing 25 associated with each arm 55.

As shown in FIG. 3, each arm 55 of the pole tube 9 drives the disk 63 along as it turns, whereby the bulge 77 of the disk 63 glides along the guide track 81 of the stationary projection 79 on the intermediate bearing 25 and is thereby pushed forward along with the driven shaft 33 in the direction of the flywheel ring gear 47 of the internal combustion engine. In this fashion, the driven shaft 33, first of all, is pushed forward until the teeth of the pinion 45 of the starter meet the teeth of the flywheel ring gear 47 of the internal combustion engine. By means of the helical spline 35 between the drive shaft 29 and the driving element 31, the driven shaft 33, with the flywheel ring gear 45, is driven further forward against the spring force of the pinion-engaging spring 71 and turned until the teeth of the pinion 45 meet tooth spaces in the flywheel ring gear 47 of the internal combustion engine and a further pushing-forward of the driven shaft causes the pinion 45 to mesh with the flywheel ring gear 47. With this, the pushing-forward of the driven shaft 33 is terminated.

FIG. 3 shows the position of the pole tube 9 and the disk 63 in this pinion-engaging position. Due to a further turning motion of the pole tube 9 until it meets the stop 61 of the opening 57 in the stationary intermediate bearing 25, the disk 63 is pushed forward against the spring force of the pinion-engaging spring 71 until it is pushed over the end face of at least one shoulder 83 extending in the axial direction and integrally molded on the intermediate bearing 25. In this position, the disk 63, together with the driven shaft 33, is locked in place. This position is shown in FIG. 4.

After the pinion-engaging procedure described hereinabove has been completed, the internal combustion engine is cranked by the pinion 45 of the driven shaft 33 driven by the starter motor until sustained operation of the internal combustion engine occurs. This takes the load off of the starter motor. As a result, the motor current drops off and, therefore, the torque acting on the pole tube 9 becomes weaker. If the torque exerted on the pole tube 9 falls below a certain value, the spring force of a pole tube-return spring not shown in the drawing prevails, the disk 63 is released, and the pinion-disengaging spring 73 presses the disk 63—together with the driven shaft 33—in the direction of the starter motor. The disk 63, guided through the guide track 81 on the stationary projection 79, is turned along with the pole tube 9 in the counter-clockwise direction until the pole tube 9 with its arms 55 is turned back to the stop 59 of the respective opening 57 in the intermediate bearing 35. During this procedure, the pinion 45 disengages from the flywheel ring gear 47 of the internal combustion engine. This pinion-disengaging procedure is also initiated when the current of the starter motor is switched off, e.g., when the ignition key is released.

In a design variant, it is provided that the disk 63 and the intermediate bearing 25 are designed somewhat differently. While, in that case, the shoulder 83 projects into an opening of the disk 63 and serves as a radial stop for the opening in the disk 63, it is provided in a further exemplary embodiment, on the one hand, that the opening in the disk 63 designed as a slightly bent slot is located between two bulges 77. On the other hand, it is provided that the shoulder 83 is therefore not located in the region of the guide track 81, but instead is located on an axial end face of the projection 79.

The individual shoulder 83 is now designed as a pin extending in the axial direction out of the projection 79. This pin is designed as a metallic pin and is pressed into the intermediate bearing 25. This pin has the advantage of high resistance to wear. Instead of this, it can be injection-molded with the intermediate bearing 25. Furthermore, the pin—which is preferably composed of steel—can also be acoustically irradiated using an ultrasonic jointing method, or it can be screwed into place.

Since the shoulder is more wear-resistant when it is composed of metal, the disk 63 can be made thinner, which results in advantages due to lower weight and reduced mass moment of inertia.

Figure 5:
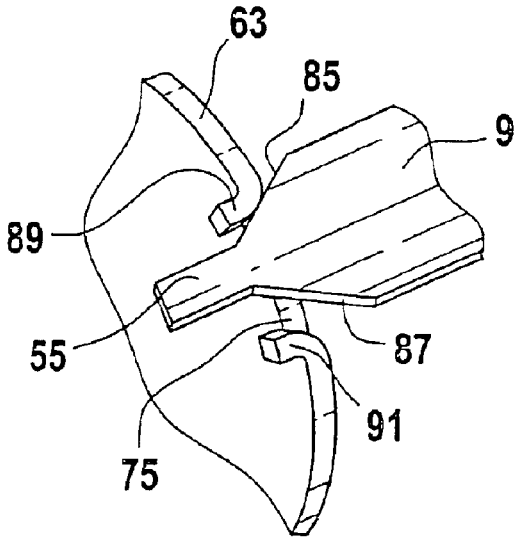
FIG. 5 is a section of a disk located on the driven shaft with an arm of the pole tube engaged therein.

In deviation from the exemplary embodiment shown in FIGS. 1 through 4, the turning motion of the pole tube 9 can be converted into an axial motion of the driven shaft 33 in many other ways. Basically, this conversion is carried out using means that comprise a guide track and a guide device that glides along said guide track, whereby the guide track or the guide device is mechanically linked with the axially displaceable driven shaft, and the guide device or the guide track is located on a part of the starter that does not move axially with the driven shaft. The pole tube 9 must be mechanically linked with the guide track or the guide device in such a fashion that the guide device glides along the guide track when the pole tube 9 executes a turning motion. The guide track and the guide device must comprise a shape that allows the driven shaft 33 to execute an axial motion when the guide device glides along the guide track. In the example shown in FIG. 5, which shows a section of the pole tube 9 and the disk 33 located on the driven shaft 33, the guide track is formed by the arm 55 of the pole tube 9. In fact, the region of the pole tube arm 55 that projects into the opening 75 in the disk 63 comprises lateral flanks 85 and 87 tapering downward in the direction toward the disk 63. These lateral flanks 85, 87 form guide tracks for the shoulders 89 and 91 bordering the opening 75. If the pole tube 9 is turned, the shoulder 89 glides along the lateral flank 85, or the shoulder 91 glides along the lateral flank 87 of the pole tube 9, by way of which the disk 63 is pushed forward. In order to reduce a restriction of the shoulders 89 and/or 91 on the lateral flanks 85 and/or 87 of the pole tube 9, the shoulders 89 and 91 are rounded off.

Balls or rolling elements can be inserted between the exemplary embodiments of guide track and guide device described hereinabove in order to reduce the friction between the two.

What is claimed is:

1. A starter for an internal combustion engine that comprises a starter motor (5, 7), a drive shaft (29) capable of being driven by the starter motor (5, 7), and a driven shaft (33) that is mechanically linked with the drive shaft (29) and is displaceable in the direction of its longitudinal axis, which said driven shaft is equipped with a pinion (45) capable of being pushed into mesh with a flywheel ring gear (47) of the internal combustion engine, whereby a pushing-forward of the driven shaft (33) to engage the pinion (45) in the flywheel ring gear (47) takes place by means of an element (9) located on the stator (5) of the starter motor (5, 7), which said element undergoes a turning motion around the motor axis when the starter motor (5, 7) is energized, wherein means (55, 63, 77, 79, 85, 89, 91) are provided that convert the turning motion of the stator element (9) directly into an axial motion acting on the driven shaft (33).

2. The starter according to claim 1, wherein the means comprise a guide track (81, 85, 87) and a guide device (77, 89, 91) capable of gliding along said guide track, whereby the guide track (81, 85, 87) or the guide device (77, 89, 91) is mechanically linked with the axially displaceable driven shaft (33), and the guide device (77, 89, 91) or the guide track (81, 85, 87) is located on a part (25) of the starter that does not move axially with the driven shaft (33), wherein the stator element (9) has a mechanical linkage with the guide track (81, 85, 87) or the guide device (77, 89, 91) that allows the guide device (77, 89, 91) to glide along the guide track (81, 85, 87) when the stator element (9) executes a turning motion, and wherein the guide track (81, 85, 87) and the guide device (77, 89, 91) comprise shapes that allow the driven shaft (33) to execute an axial motion when the guide device (77, 89, 91) glides along the guide track (81, 85, 87).

3. The starter according to claim 1, wherein a substantially radially projecting disk (63) is supported on the driven shaft (33) in such a fashion that it is capable of being turned around the axis of the driven shaft (33) and bears axially against a spring force (71) in the advancing direction.

4. The starter according to claim 2, wherein the stator element (9) is interconnected with the disk (63) with positive and/or non-positive engagement in such a fashion that, when the stator element (9) executes a turning motion, a guide device (77) located on the disk (63) glides along a guide track (81) rising in the advancing direction of the driven shaft (33), whereby the disk (63) executes an axial motion with the driven shaft (33).

5. The starter according to claim 2, wherein the guide track (85, 87) or the guide device is located on the stator element (9).

6. The starter according to claim 1, wherein a pole tube (9) belonging to the stator (5) of the starter motor is supported in a fashion that allows it to turn around the motor axis, and wherein a spring element is provided that counteracts the torque acting on the pole tube (9) that is generated when the motor is energized.

7. The starter according to claim 3, wherein a spring element (73) is inserted between the disk (63) and the housing (3) of the starter that exerts a spring force opposed to the advancing direction on the disk (63) and, therefore, on the driven shaft (33).

8. The starter according to claim 1, wherein the drive shaft (29) drives the driven shaft (33) via a helical spline.

* * * * *